US010436503B2

(12) United States Patent
Rotter et al.

(10) Patent No.: US 10,436,503 B2
(45) Date of Patent: Oct. 8, 2019

(54) DRAWER ASSEMBLY AND METHOD OF MOUNTING THE DRAWER ASSEMBLY IN A REFRIGERATED COMPARTMENT

(71) Applicant: Whirlpool Corporation, Benton Harbor, MI (US)

(72) Inventors: Chad Rotter, Saugatuck, MI (US); Sanket V Phalak, Pune (IN); Jeevan S Yadav, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 322 days.

(21) Appl. No.: 15/383,145

(22) Filed: Dec. 19, 2016

(65) Prior Publication Data

US 2018/0172341 A1 Jun. 21, 2018

(51) Int. Cl.
*F25D 25/02* (2006.01)

(52) U.S. Cl.
CPC ..... *F25D 25/025* (2013.01); *A47B 2210/175* (2013.01)

(58) Field of Classification Search
CPC ..... F25D 25/025; A47B 2088/4272; A47B 2088/0425; A47B 2088/4274; A47B 2088/0429; A47B 2088/4276; A47B 2088/0433; A47B 2088/4278; A47B 2088/0437; A47B 2210/175; A47B 2210/09; A47B 2210/091; A47B 2210/098; A47B 88/407; A47B 88/0407; A47B 88/423; A47B 88/0418; A47B 88/427; A47B 88/0422
See application file for complete search history.

(56) References Cited

U.S. PATENT DOCUMENTS

| | | | | |
|---|---|---|---|---|
| 2,868,607 A | | 1/1959 | Squire | |
| 3,722,964 A | | 3/1973 | Chitester et al. | |
| 4,042,288 A | * | 8/1977 | Litchfield | A47B 88/941 160/381 |
| 4,108,520 A | * | 8/1978 | Litchfield | A47B 88/941 312/111 |
| 6,199,967 B1 | * | 3/2001 | Bayles | A47B 88/427 248/222.11 |
| 7,406,833 B2 | * | 8/2008 | Ertz | F25D 23/021 62/115 |

(Continued)

FOREIGN PATENT DOCUMENTS

| | | | | |
|---|---|---|---|---|
| DE | 3347540 A1 | * | 7/1985 | A47B 88/427 |
| DE | 102007051343 A1 | * | 4/2009 | F25D 25/025 |

(Continued)

*Primary Examiner* — Andrew M Roersma
(74) *Attorney, Agent, or Firm* — Diederiks & Whitelaw, PLC.

(57) ABSTRACT

A refrigerator includes a refrigerated compartment and a door configured to selectively seal the refrigerated compartment. A drawer assembly is mounted in the refrigerated compartment. The drawer assembly includes a glide and a drawer. The glide has a glide rail movable relative to the refrigerated compartment and a glide endcap directly coupled to the glide rail. The drawer has a front wall, a rear wall, a bottom wall, opposing side walls and a retaining clip. The retaining clip is directly coupled to the glide endcap. The retaining clip and the glide endcap prevent the drawer from moving vertically relative to the glide rail.

23 Claims, 11 Drawing Sheets

(56) References Cited

U.S. PATENT DOCUMENTS

| | | | | |
|---|---|---|---|---|
| 7,604,307 | B2 * | 10/2009 | Greenwald | A47B 88/49 312/333 |
| 8,708,436 | B2 | 4/2014 | Laible | |
| 8,882,210 | B2 * | 11/2014 | Hammerle | G01G 19/024 312/330.1 |
| 9,285,155 | B2 | 3/2016 | Yoo et al. | |
| 2007/0138804 | A1 | 6/2007 | Koloff et al. | |
| 2009/0121599 | A1 * | 5/2009 | Laible | F25D 25/025 312/404 |
| 2015/0192351 | A1 | 7/2015 | Kang et al. | |
| 2016/0128475 | A1 | 5/2016 | Jahrling et al. | |
| 2016/0153700 | A1 | 6/2016 | Yoo et al. | |
| 2016/0216027 | A1 | 7/2016 | Go et al. | |
| 2017/0146286 | A1 * | 5/2017 | Moon | F25D 25/025 |

FOREIGN PATENT DOCUMENTS

| | | | | |
|---|---|---|---|---|
| EP | 2564729 | A1 * | 6/2013 | F25D 25/02 |
| EP | 2982268 | A1 * | 2/2016 | A47B 88/956 |
| KR | 1020090133009 | A * | 12/2009 | F25D 25/025 |
| WO | WO 2007062961 | A1 * | 6/2007 | A47B 88/427 |
| WO | WO 2015030546 | A1 * | 3/2015 | F25D 25/025 |

* cited by examiner

DRAWER ASSEMBLY AND METHOD OF MOUNTING THE DRAWER ASSEMBLY IN A REFRIGERATED COMPARTMENT

BACKGROUND OF THE INVENTION

The present invention pertains to the art of refrigeration and, more particularly, to a crisper drawer for a refrigerator.

Typically, a refrigerator includes one or more crisper drawers for storing food items, such as fruits and vegetables, at a desired humidity level. To facilitate opening and closing of the drawers, the drawers are generally coupled to glide rails. Although the glide rails restrict lateral movement of a drawer, the glide rails do not restrict vertical movement of the drawer. In particular, when a user pulls on a drawer to open it, the force applied by the user often has a vertical component, in addition to the horizontal component, due to the location of such drawers within a refrigerator. As a result, the front of the drawer will be lifted upward off the glide rails when the user pulls on the drawer. In other words, the drawer is caused to pivot about its rear portion, which remains in contact with the glide rails. This is considered undesirable. Accordingly, it would be beneficial to provide a crisper drawer that does not move vertically when the drawer is pulled opened by a user. Preferably, the drawer would also provide locking feedback to the user when the drawer is closed.

SUMMARY OF THE INVENTION

The present invention is directed to a refrigerator comprising a refrigerated compartment and a door configured to selectively seal the refrigerated compartment. A drawer assembly is mounted in the refrigerated compartment. The drawer assembly includes a glide and a drawer. The glide has a glide rail movable relative to the refrigerated compartment and a glide endcap directly coupled to the glide rail. The drawer has a front wall, a rear wall, a bottom wall, opposing side walls and a retaining clip. The retaining clip is directly coupled to the glide endcap. The retaining clip and the glide endcap prevent the drawer from moving vertically relative to the glide rail.

Preferably, the glide endcap includes a lug, the retaining clip includes a hole and the lug extends through the hole. The lug has a first portion that is sloped downward and forward relative to a front face of the glide endcap. The glide endcap and the retaining clip are configured so that the retaining clip contacts and slides across the first portion during attachment of the drawer to the glide. The retaining clip has a second portion that is angled rearward relative to a front face of the retaining clip, and the hole is formed in the second portion. During coupling of the retaining clip to the glide endcap, the second portion is caused to deflect forward until the lug enters the hole. The retaining clip has a third portion that is angled forward relative to the second portion. The retaining clip is configured so that pulling forward on the third portion causes the lug to exit the hole.

Preferably, the drawer has a slot including an aperture, the glide rail is received in the slot and the glide endcap is received in the aperture. The slot is located in one of the opposing side walls.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE INVENTION

A detailed embodiment of the present invention is disclosed herein. However, it is to be understood that the disclosed embodiment is merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

Figure 1:
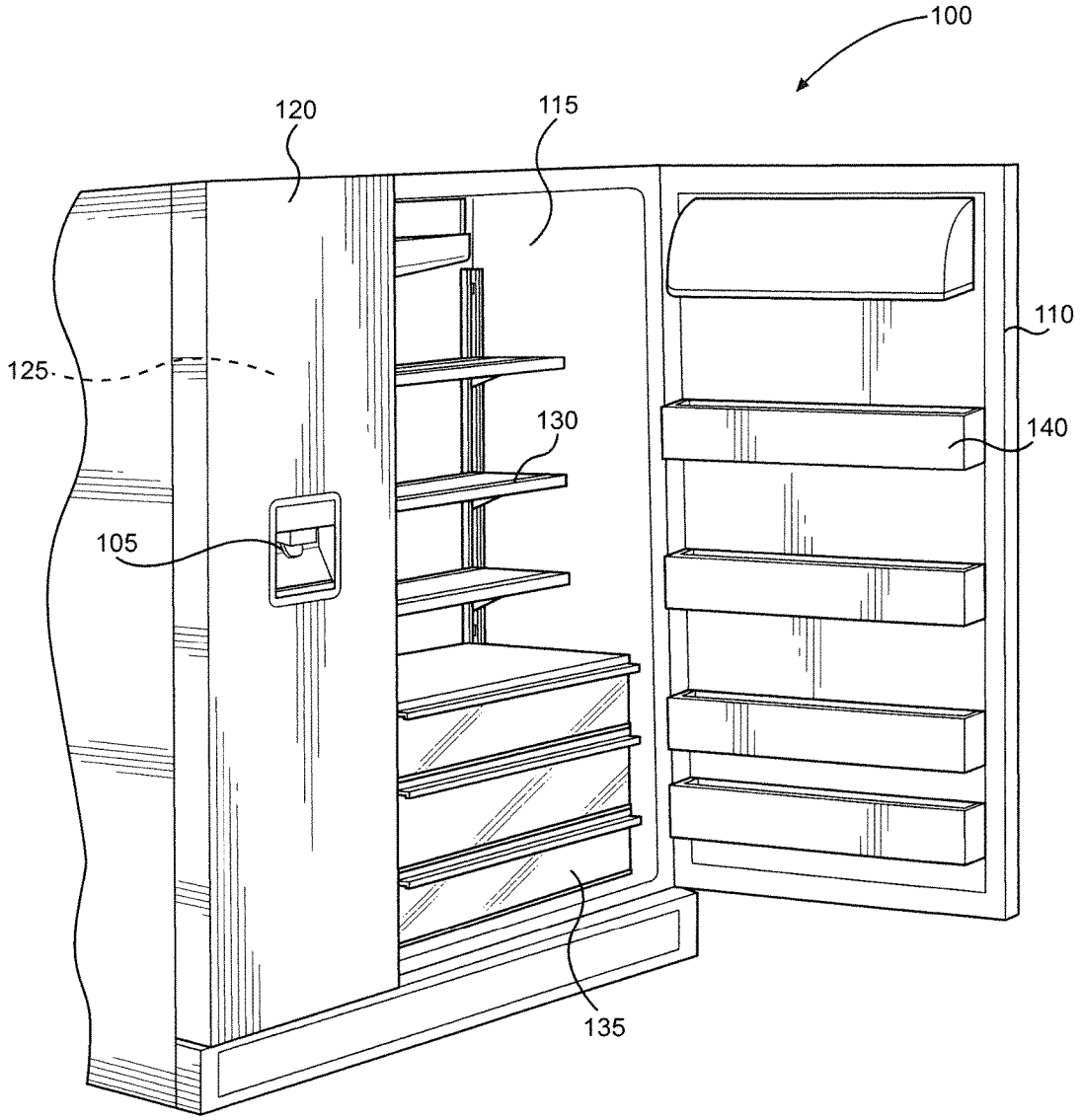
FIG. 1 is a perspective view of a refrigerator constructed in accordance with the present invention.

With initial reference to FIG. 1, there is illustrated a refrigerator 100 constructed in accordance with the present invention. Refrigerator 100 is shown in a side-by-side configuration, although the present invention can be used with other refrigerator configurations, including French door, bottom mount and top mount refrigerators. Refrigerator 100 includes a dispenser 105, which selectively dispenses ice or water when desired by a user; a fresh food door 110, which selectively seals a fresh food compartment 115; and a freezer door 120, which selectively seals a freezer compartment 125. Refrigerator 100 also includes a plurality of shelves (one of which is labeled 130), a plurality of drawers (one of which is labeled 135) and a plurality of door bins (one of which is labeled 140). Although not visible, refrigerator 100 includes a refrigeration system that establishes above and below freezing temperatures in compartments 115 and 125. In other words, the refrigeration system cools the refrigerated compartments of refrigerator 100.

Figure 2A:
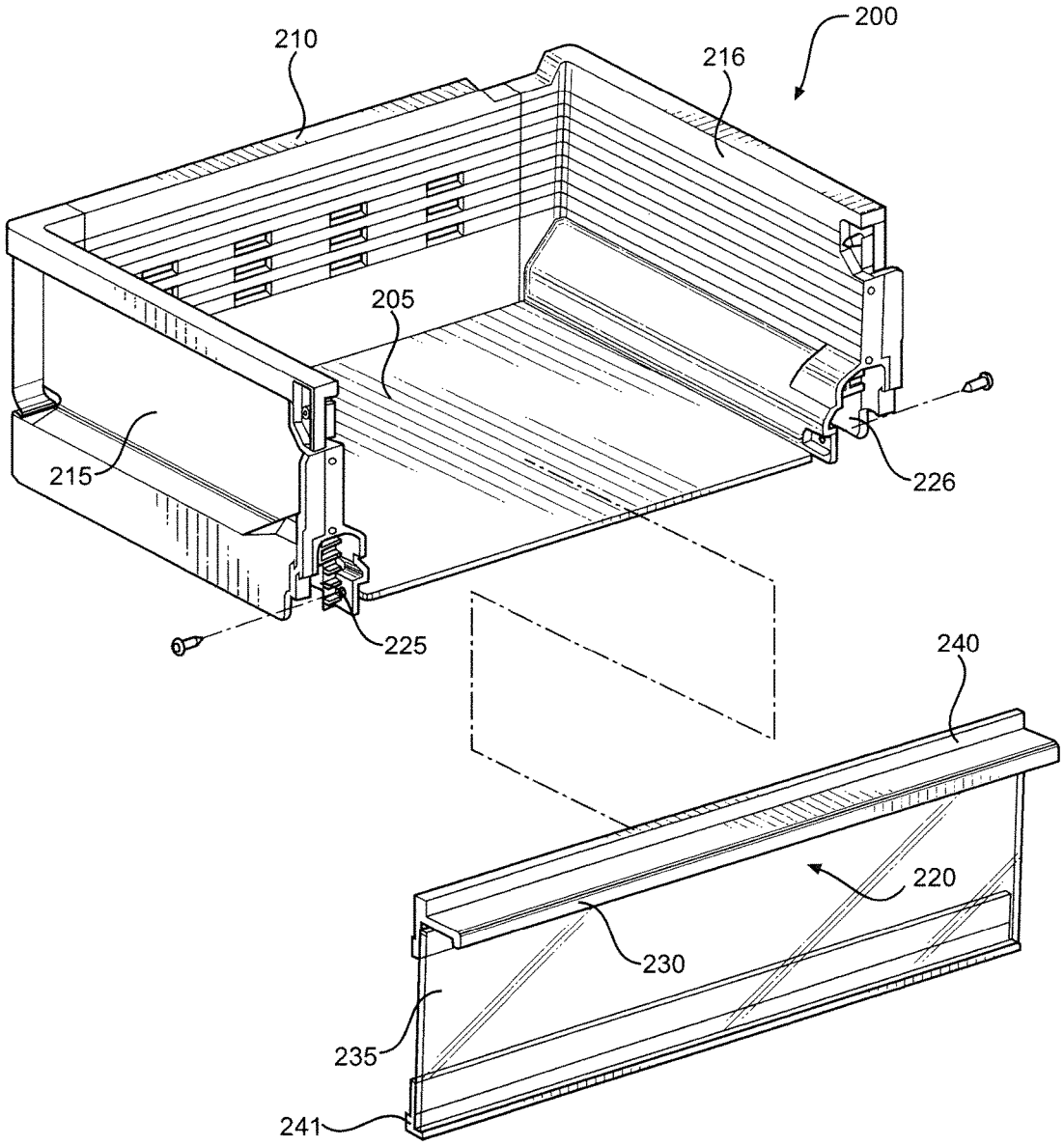
FIG. 2A PRIOR ART
FIG. 2A is an exploded perspective view of a prior art crisper drawer.

With reference now to FIG. 2A, an exploded view of a crisper drawer 200 is provided. Drawer 200 represent a prior art crisper drawer and includes a bottom wall 205, a rear wall 210, side walls 215 and 216 and a front wall 220. Side walls 215 and 216 include slots 225 and 226, respectively, for mounting drawer 200 on glide rails, as will be discussed in more detail below. Front wall 220 includes a handle 230 so that a user can pull drawer 200 open. In one embodiment, walls 205, 210, 215 and 216 are made from extruded aluminum, while front wall 220 includes a glass plate 235 and aluminum trim pieces 240 and 241. However, as is known in the art, other materials, such as plastics, can be used.

Figure 2B:
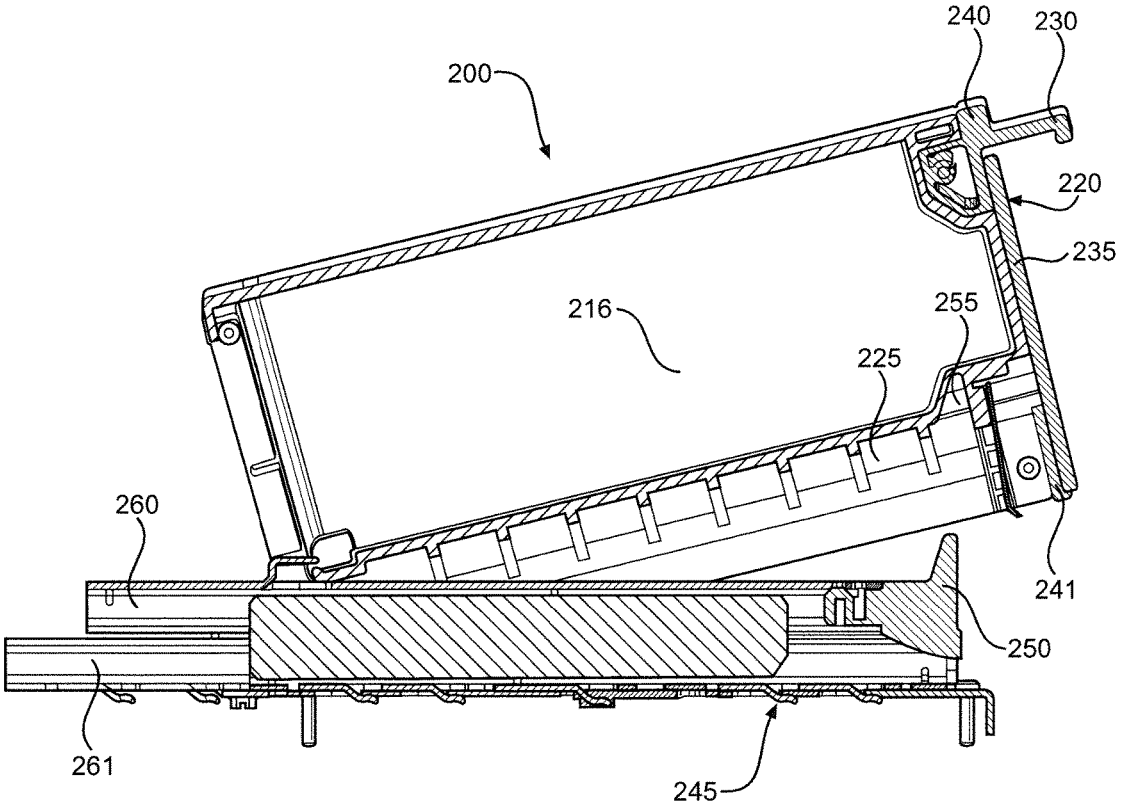
FIG. 2B PRIOR ART
FIG. 2B is a side view of the crisper drawer being coupled to a prior art glide, with the crisper drawer shown in cross section.
Figure 2C:
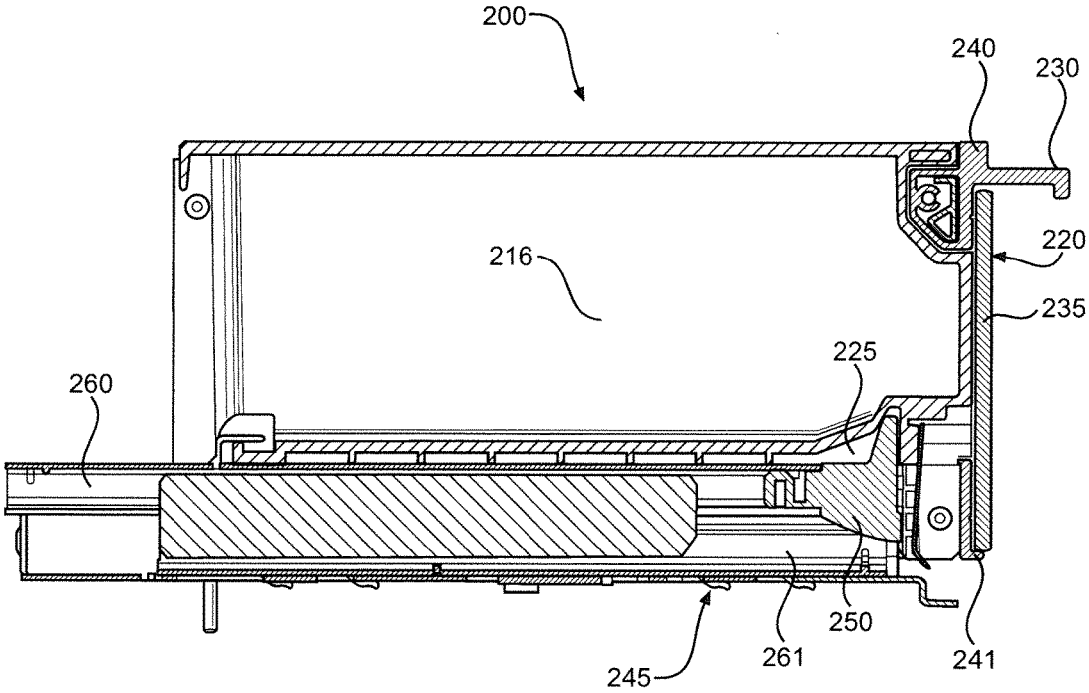
FIG. 2C PRIOR ART
FIG. 2C is a side view of the crisper drawer coupled to the glide, with the crisper drawer shown in cross section.
Figure 2D:
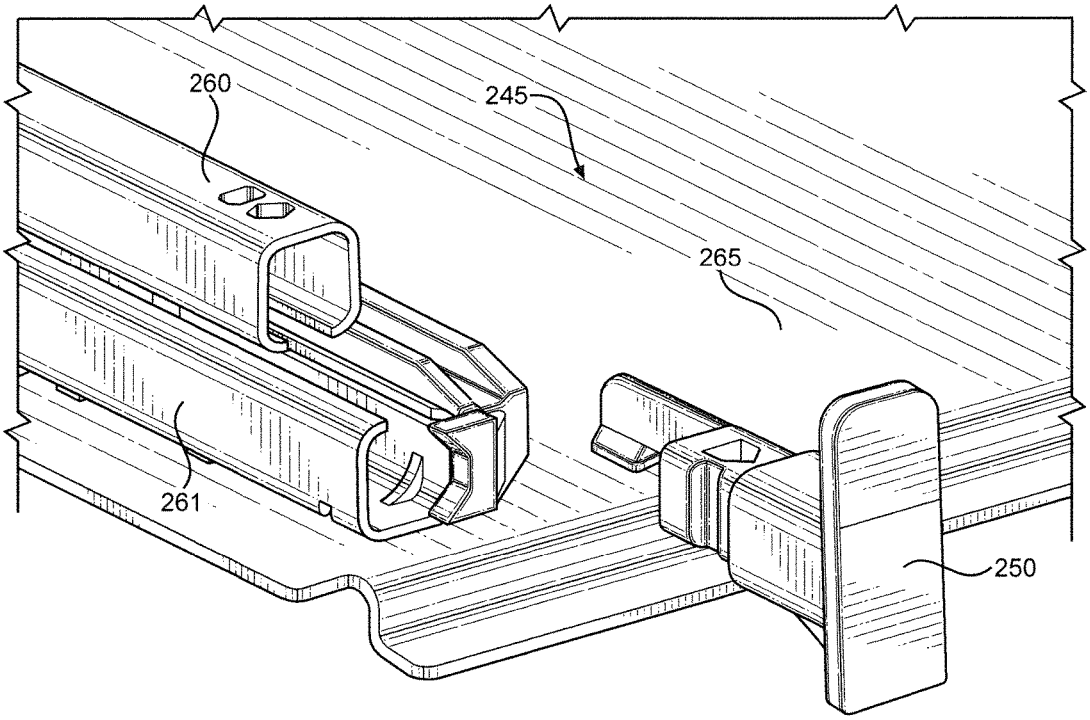
FIG. 2D PRIOR ART
FIG. 2D is an exploded perspective view of a portion of the glide.

In FIG. 2B, drawer 200 is shown being coupled to a glide 245 and, in FIG. 2C, drawer 200 is shown coupled to glide 245. FIGS. 2B and 2C represent side views of glide 245 and cross sections of drawer 200. Although only the left sides of drawer 200 and glide 245 are shown, the right sides are constructed in the same manner. To couple drawer 200 to glide 245, a glide endcap 250 is inserted into an aperture or recess 255 formed within slot 225 of side wall 215. Glide endcap 250 is directly coupled to a first glide rail 260, which is movable relative to a second glide rail 261. During attachment of drawer 200 to glide 245, first glide rail 260 is positioned in slot 225. Accordingly, when a user pulls on handle 230, drawer 200 and first glide rail 260 move relative to second glide rail 261 as well as the refrigerated compartment in which drawer 200 is located. FIG. 2D is an exploded perspective view of glide 245. As can be seen in this figure, second glide rail 261 is coupled to a glide base 265.

Figure 3A:
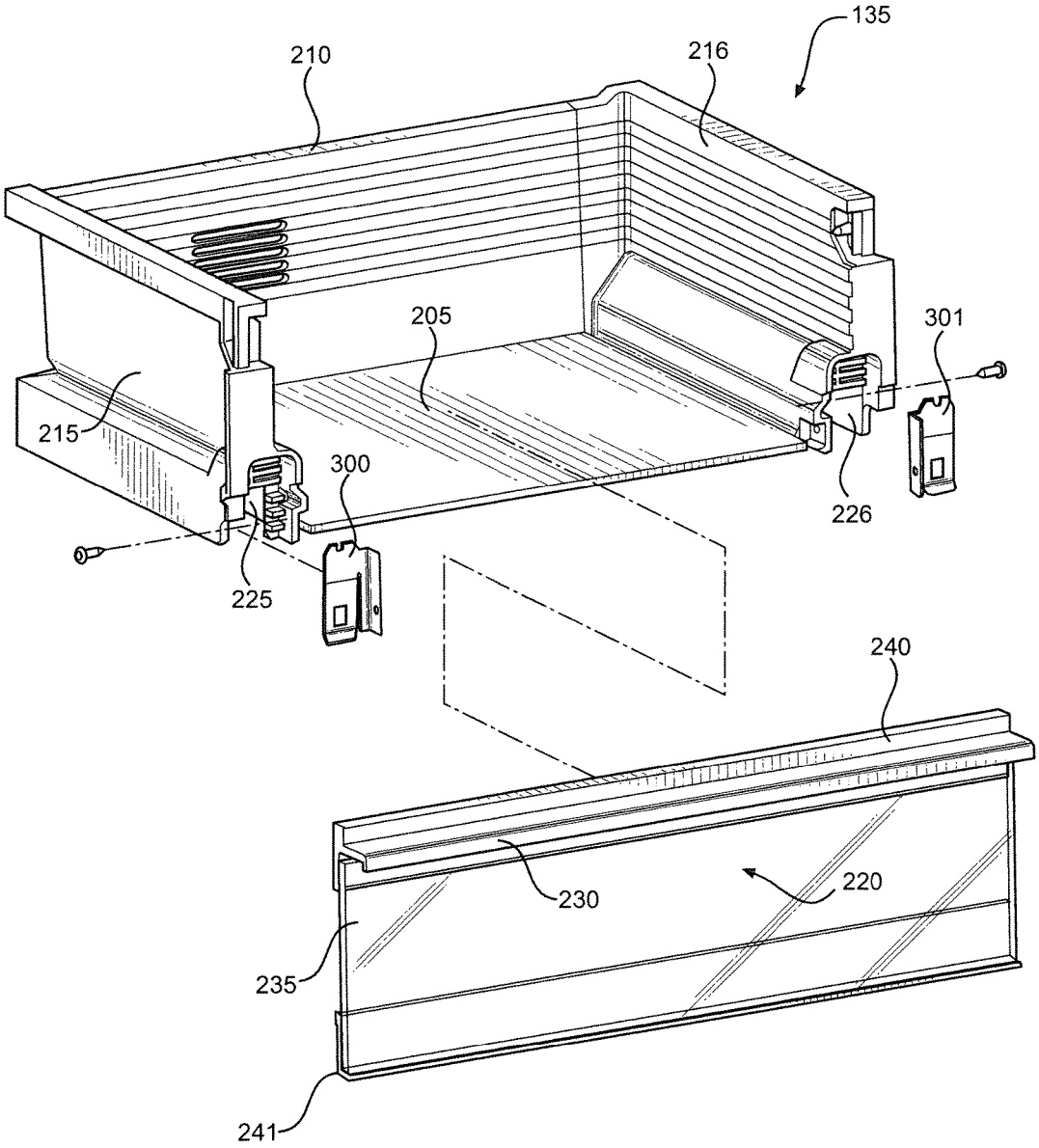
FIG. 3A is an exploded perspective view of a crisper drawer constructed in accordance with the present invention.
Figure 3B:
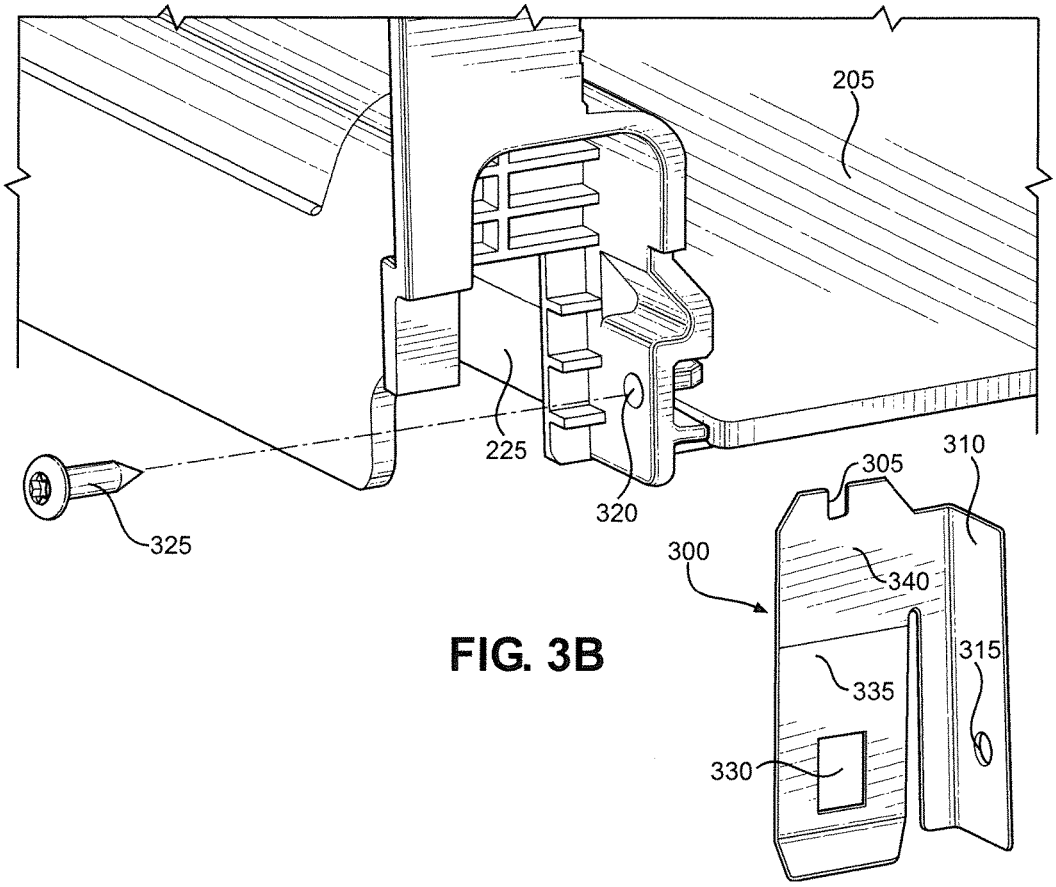
FIG. 3B is an enlarged view of a portion of FIG. 3A.

With reference now to FIG. 3A, an exploded view of crisper drawer 135 is provided. Drawer 135 is constructed in accordance with the present invention. In contrast with drawer 200, drawer 135 further includes retaining clips 300 and 301, which are coupled to side walls 215 and 216, respectively. Turning to FIG. 3B, it can be seen that clip 300 includes a notch 305 and a flange 310 having a hole 315. Side wall 215 includes a protrusion (not visible) that fits into notch 305 to align clip 300 during coupling of clip 300 to side wall 215. In addition, a hole 320 is formed in side wall 215. A mechanical fastener 325 is inserted into holes 315 and 320 to secure clip 300 to side wall 215. Preferably, fastener 320 is a metal screw, although other fastening arrangements known in the art can be used. Clip 300 also includes a rectangular hole 330 formed in a portion 335 of clip 300 that is bent or angled rearward relative to and cantilevered from a front face 340 of clip 300. The function of hole 330 and portion 335 will be discussed in more detail below. In addition, while the present invention has been described in connection with clip 300, clip 301 functions in the same manner.

Figure 4A:
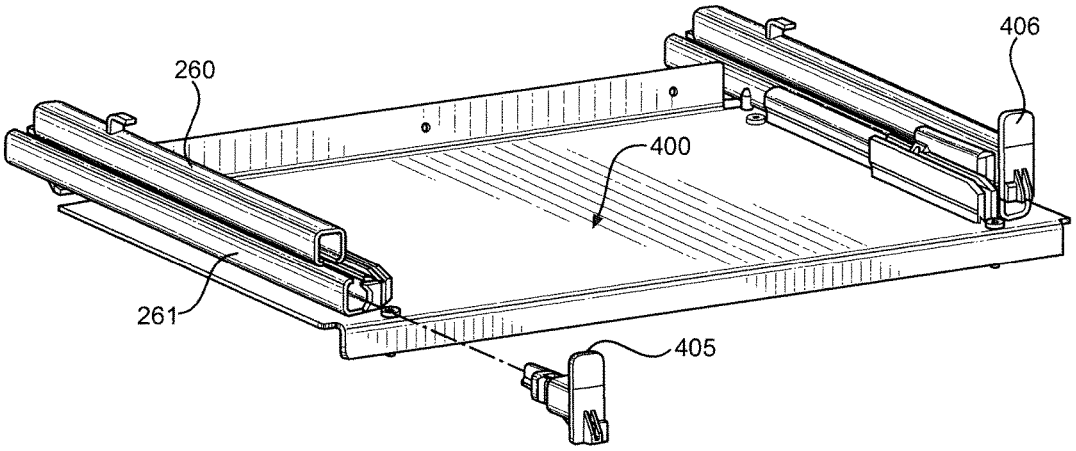
FIG. 4A is an exploded perspective view of a glide constructed in accordance with the present invention.
Figure 4B:
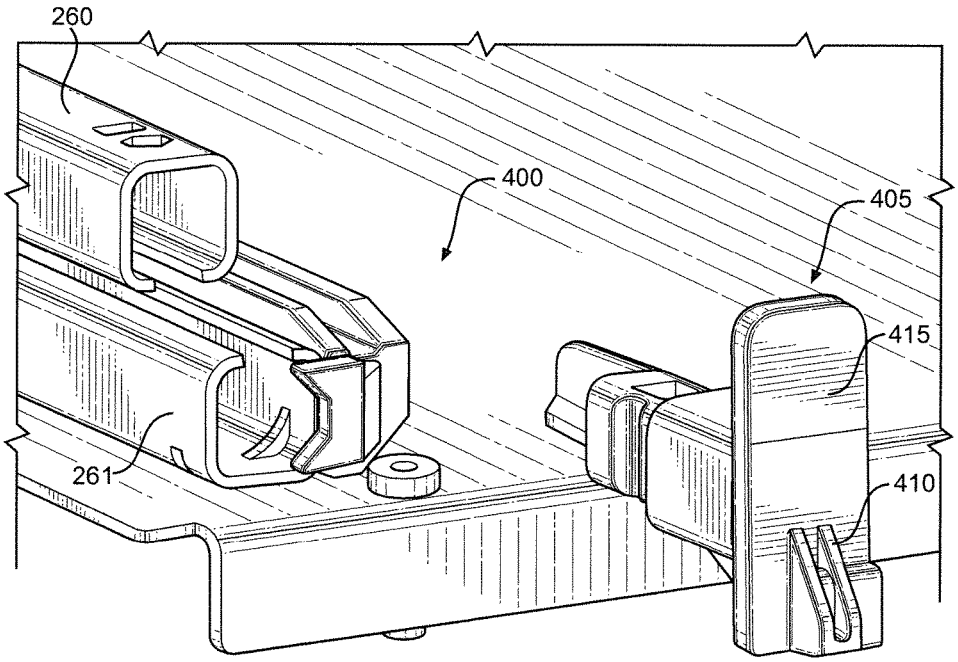
FIG. 4B is an enlarged view of a portion of FIG. 4A.
Figure 5A:
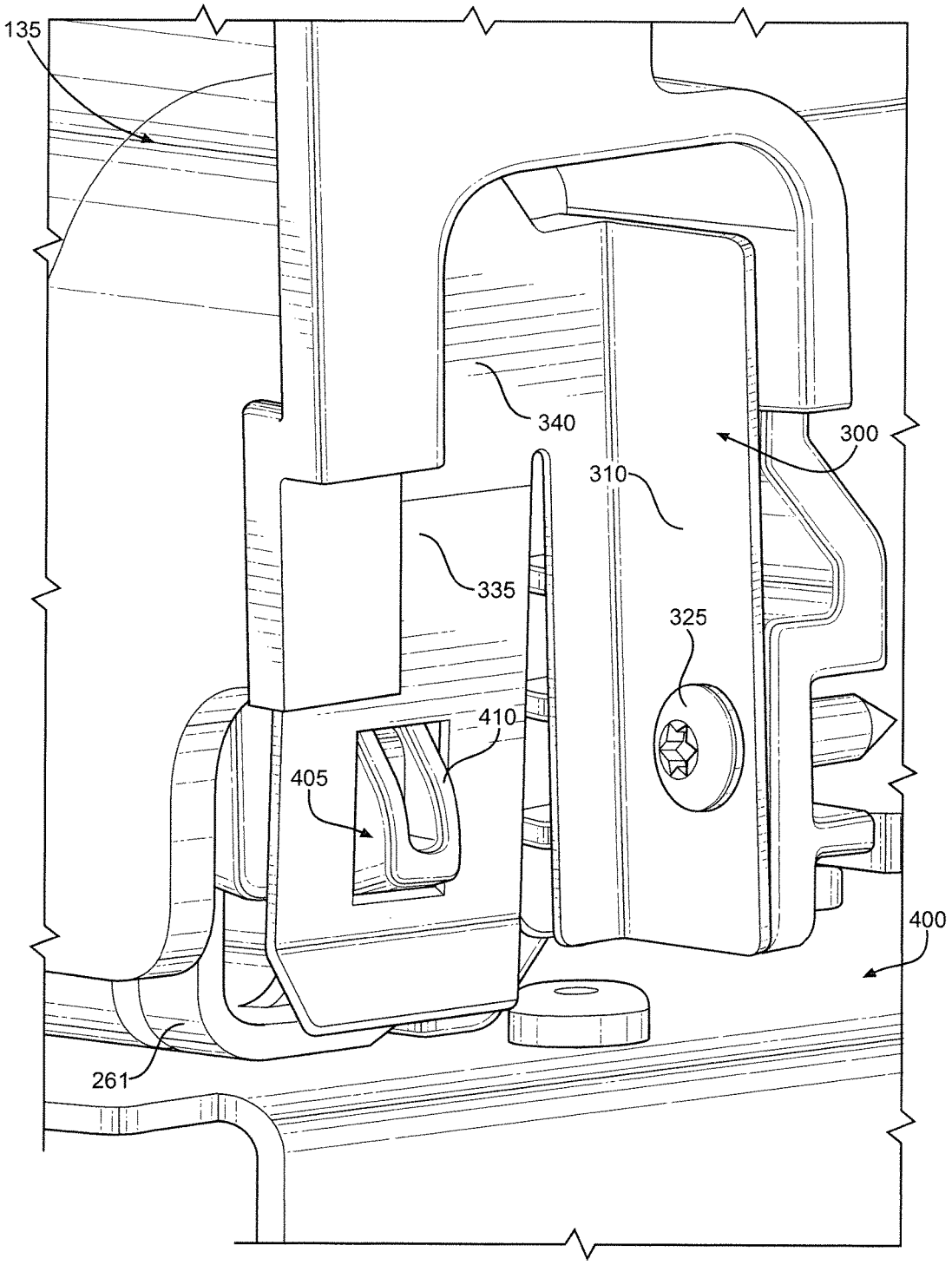
FIG. 5A is perspective view of a portion of the crisper drawer and glide of the present invention.
Figure 5B:
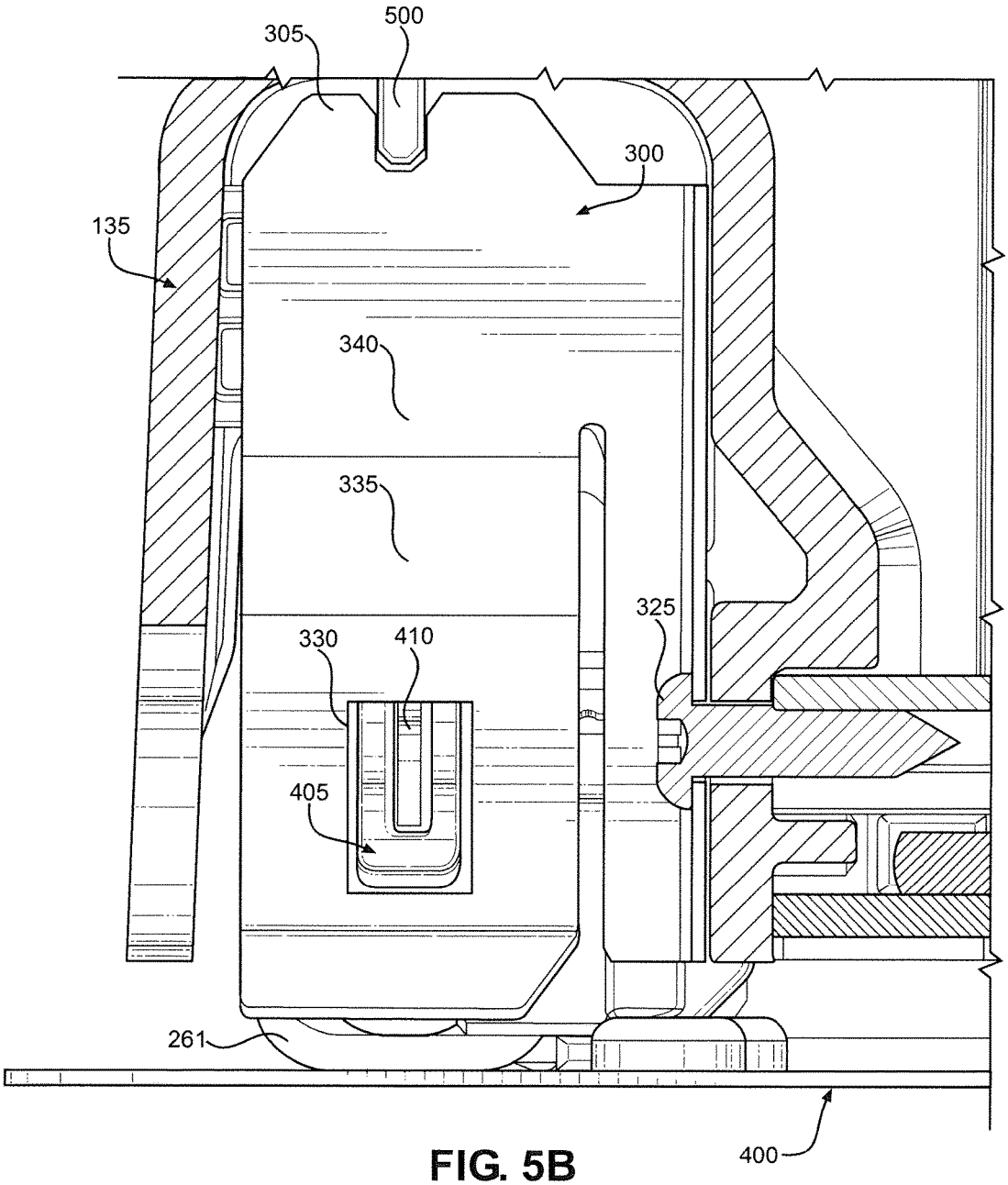
FIG. 5B is a partial cross section of the portion shown in FIG. 5A.

In FIGS. 4A and 4B, there is shown a glide 400 constructed in accordance with the present invention. Other than glide endcaps 405 and 406, glide 400 is the same as glide 245. Specifically, in contrast with glide endcap 250, glide endcap 405 includes a lug 410 extending forward from a front face 415 of endcap 405. Lug 410 mates with hole 330 of clip 300 when drawer 135 is coupled to glide 400, thereby directly coupling clip 300 to glide endcap 405, as can be seen in FIGS. 5A and 5B. Since lug 410 extends through hole 330, any vertical force generated when a user pulls on handle 230 is prevented from causing drawer 135 to move vertically relative to glide 400. In addition, a protrusion 500 can be seen in FIG. 5B. As discussed above, protrusion 500 fits into notch 305 to align clip 300 during coupling of clip 300 to side wall 215. While the present invention has been described in connection with endcap 405, endcap 406 functions in the same manner. Also, for brevity, the combination of drawer 135 and glide 400 is considered to constitute a crisper drawer assembly.

Figure 6A:
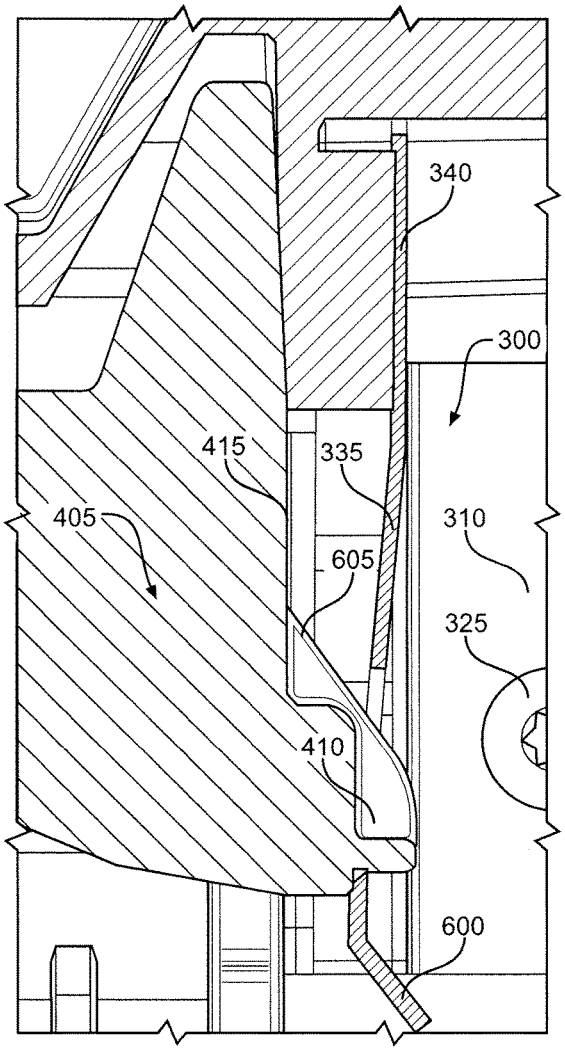
FIG. 6A is a partial cross section of the crisper drawer and glide of the present invention, with a clip shown in its default position.
Figure 6B:
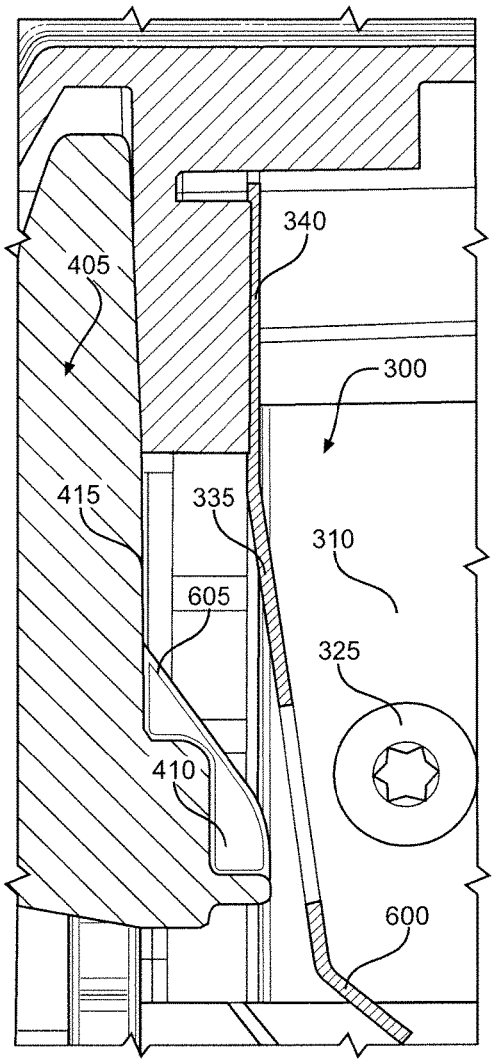
FIG. 6B is a partial cross section of the crisper drawer and glide of the present invention, with the clip shown in an unlocked position.

FIGS. 6A and 6B represent side views of glide 400 and cross sections of drawer 135. As a result, it can be seen that portion 335 of clip 300 is bent backwards by 5° relative to front face 340 of clip 300. Also, lug 410 extends through hole 330 in this position. During attachment of drawer 135 to glide 400, lug 410 causes portion 335 to be deflected forward until lug 410 enters hole 330, at which point portion 335 is biased to return to its default position. If a user wishes to detach drawer 135 from glide 400, the user can pull clip 300 forward approximately 15° using a terminal portion 600 of clip 300 that is bent or angled forward relative to portion 335. This causes lug 410 to exit hole 330. At this point, the user can lift drawer 135 upward to detach drawer 135 from glide 400. In addition to helping the user detach drawer 135 from glide 400, portion 600 also helps clip 300 slide along endcap 405 during attachment of drawer 135 to glide 400. Along these lines, lug 410 has a portion 605 that slopes downward and forward relative to front face 415 of endcap 405. Portion 605 serves to guide clip 300 along endcap 405 during attachment of drawer 135 to glide 400. Specifically, clip 300 contacts and slides along portion 605. Another benefit of this arrangement is that the feedback that results when lug 410 enters hole 330 and clip 300 returns to its default position lets the user know that drawer 135 has been properly attached to glide 400.

Based on the above, it should be readily apparent that the present invention provides a crisper drawer that does not move vertically when the drawer is pulled opened by a user. In addition, the drawer provides locking feedback to the user when the drawer is closed. Although described with reference to a preferred embodiment, it should be readily understood that various changes or modifications could be made to the invention without departing from the spirit thereof. For example, although the present invention is described in connection with a crisper drawer, the present invention can be used in connection with other drawers. Also, while slots 225 and 226 are shown as being formed in side walls 215 and 216, slots 225 and 226 can be formed in bottom wall 205. In addition, hole 330 need not be rectangular. In general, the invention is only intended to be limited by the scope of the following claims.

The invention claimed is:

1. A refrigerator comprising:
- a refrigerated compartment;
- a door configured to selectively seal the refrigerated compartment;
- a drawer assembly mounted in the refrigerated compartment, wherein the drawer assembly includes:
  - a glide having:
    - a glide rail movable relative to the refrigerated compartment; and
    - a glide endcap directly coupled to the glide rail; and
  - a drawer having:
    - a front wall, a rear wall, a bottom wall and opposing side walls;
    - a retaining clip directly coupled to the glide endcap, wherein the retaining clip and the glide endcap prevent the drawer from moving vertically relative to the glide rail.

2. The refrigerator of claim 1, wherein:
- the glide endcap includes a lug;
- the retaining clip includes a hole; and
- the lug extends through the hole.

3. The refrigerator of claim 2, wherein:
- the lug has a first portion that is sloped downward and forward relative to a front face of the glide endcap; and the glide endcap and the retaining clip are configured so that the retaining clip contacts and slides across the first portion during attachment of the drawer to the glide.

4. The refrigerator of claim 3, wherein:

the retaining clip has a second portion that is angled rearward relative to a front face of the retaining clip; and the hole is formed in the second portion.

5. The refrigerator of claim 4, wherein:

the retaining clip has a third portion that is angled forward relative to the second portion; and the retaining clip is configured so that pulling forward on the third portion causes the lug to exit the hole.

6. The refrigerator of claim 1, wherein:

the drawer has a slot including an aperture;

the glide rail is received in the slot; and the glide endcap is received in the aperture.

7. The refrigerator of claim 6, wherein the slot is located in one of the opposing side walls.

8. A drawer assembly comprising:

a glide including:

a glide rail; and a glide endcap directly coupled to the glide rail; and a drawer including:

a front wall, a rear wall, a bottom wall and opposing side walls;

a retaining clip directly coupled to the glide endcap, wherein the retaining clip and the glide endcap prevent the drawer from moving vertically relative to the glide rail.

9. The drawer assembly of claim 8, wherein:

the glide endcap includes a lug;

the retaining clip includes a hole; and the lug extends through the hole.

10. The drawer assembly of claim 9, wherein:

the lug has a first portion that is sloped downward and forward relative to a front face of the glide endcap; and the glide endcap and the retaining clip are configured so that the retaining clip contacts and slides across the first portion during attachment of the drawer to the glide.

11. The drawer assembly of claim 10, wherein:

the retaining clip has a second portion that is angled rearward relative to a front face of the retaining clip; and the hole is formed in the second portion.

12. The drawer assembly of claim 11, wherein:

the retaining clip has a third portion that is angled forward relative to the second portion; and the retaining clip is configured so that pulling forward on the third portion causes the lug to exit the hole.

13. The drawer assembly of claim 8, wherein:

the drawer has a slot including an aperture;

the glide rail is received in the slot; and the glide endcap is received in the aperture.

14. The drawer assembly of claim 13, wherein the slot is located in one of the opposing side walls.

15. A method of mounting a drawer in a refrigerated compartment of a refrigerator, the drawer including a front wall, a rear wall, a bottom wall and opposing side walls, and the refrigerator including a door configured to selectively seal the refrigerated compartment, the method comprising:

coupling the drawer to a glide having a glide rail movable relative to the refrigerated compartment and a glide endcap directly coupled to the glide rail, wherein coupling the drawer to the glide includes:

directly coupling a retaining clip of the drawer to the glide endcap, wherein the retaining clip and the glide endcap prevent the drawer from moving vertically relative to the glide rail.

16. The method of claim 15, wherein:

the glide endcap includes a lug;

the retaining clip includes a hole; and directly coupling the retaining clip to the glide endcap includes causing the lug to extend through the hole.

17. The method of claim 16, wherein:

the lug has a first portion that is sloped downward and forward relative to a front face of the glide endcap; and directly coupling the retaining clip to the glide endcap includes causing the retaining clip to contact and slide across the first portion.

18. The method of claim 17, wherein:

the retaining clip has a second portion that is angled rearward relative to a front face of the retaining clip;

the hole is formed in the second portion; and directly coupling the retaining clip to the glide endcap includes causing the second portion to deflect forward until the lug enters the hole.

19. The method of claim 18, wherein the retaining clip has a third portion that is angled forward relative to the second portion, the method further comprising detaching the drawer from the glide by pulling forward on the third portion to cause the lug to exit the hole.

20. The method of claim 15, wherein:

the drawer has a slot including an aperture; and coupling the drawer to the glide includes positioning the glide rail in the slot and the glide endcap in the aperture.

21. The refrigerator of claim 1, wherein:

the glide endcap includes a lug;

the retaining clip includes a hole;

the lug extends through the hole; and the retaining clip is configured so that pulling on the retaining clip causes the lug to exit the hole.

22. The drawer assembly of claim 8, wherein:

the glide endcap includes a lug;

the retaining clip includes a hole;

the lug extends through the hole; and the retaining clip is configured so that pulling on the retaining clip causes the lug to exit the hole.

23. The method of claim 15, wherein:

the glide endcap includes a lug;

the retaining clip includes a hole; and directly coupling the retaining clip to the glide endcap includes causing the lug to extend through the hole, the method further comprising detaching the drawer from the glide by pulling on the retaining clip to cause the lug to exit the hole.

* * * * *